US011322052B2

(12) United States Patent
Holtz-Davis et al.

(10) Patent No.: US 11,322,052 B2
(45) Date of Patent: May 3, 2022

(54) WATER AIR LAND TRACKS BAGGAGE IDENTIFICATION LOCATOR COMPUTER PRODUCT AND METHODS

(76) Inventors: Frankie Holtz-Davis, North Las Vegas, NV (US); Derrick Holtz, Mira Loma, CA (US)

( * ) Notice: Subject to any disclaimer, the term of this patent is extended or adjusted under 35 U.S.C. 154(b) by 884 days.

(21) Appl. No.: 12/983,814

(22) Filed: Jan. 3, 2011

(65) Prior Publication Data

US 2011/0094131 A1 Apr. 28, 2011

Related U.S. Application Data

(62) Division of application No. 12/008,614, filed on Jan. 10, 2008, now Pat. No. 7,886,464.

(51) Int. Cl.
*G09F 3/14* (2006.01)
*G09F 3/02* (2006.01)

(52) U.S. Cl.
CPC ..... *G09F 3/14* (2013.01); *G09F 2003/0254* (2013.01)

(58) Field of Classification Search
CPC .... G09F 3/14; G09F 2003/0254; G09F 3/208; G06K 19/0723; G06K 19/07758
USPC ..... 340/10.52
See application file for complete search history.

(56) References Cited

U.S. PATENT DOCUMENTS 5,560,657 A * 10/1996 Morgan ..... G09F 3/14 283/80
5,831,531 A * 11/1998 Tuttle ..... 340/568.2
5,920,053 A * 7/1999 DeBrouse ..... B64F 1/366 235/375
7,151,454 B2 * 12/2006 Washington ..... 340/572.1
2004/0124982 A1 * 7/2004 Kovach ..... 340/572.1
2005/0001041 A1 * 1/2005 McCarthy ..... G09F 3/0335 235/492
2006/0225332 A1 * 10/2006 Zenisek ..... G09F 3/10 40/638

* cited by examiner

*Primary Examiner* — Vernal U Brown
(74) *Attorney, Agent, or Firm* — Barry Choobin; Patent 360

(57) ABSTRACT

Disclosed is a method for locating, tracking and securing luggage. The method comprises steps of providing luggage tags configured with a luggage identifier code. The luggage identifier code is associated with a travel profile. The luggage tags further comprising one or more tamper-proof fasteners associated with one or more luggage tags. The luggage identifier code help to locate and track the luggage, while the tamper-proof fasteners help to secure the luggage.

9 Claims, 13 Drawing Sheets

WATER AIR LAND TRACKS BAGGAGE IDENTIFICATION LOCATOR COMPUTER PRODUCT AND METHODS

CROSS-REFERENCES TO RELATED APPLICATIONS

This application is a divisional of U.S. application Ser. No. 12/008,614, filed Jan. 10, 2008, the disclosure of which is incorporated herein by reference in its entirety.

BACKGROUND

The present invention relates generally to travel related accessories, and more particularly to a method, apparatus and kit for providing a more reliable means of locating luggage easily while traveling and more particularly to reducing the risk of loss of luggage by pairing luggage and a traveler by an easy to identify indicia and identity information.

It is estimated that lost luggage in the travel industry is about 20 million pieces per year. Recently the U.S. Department of transportation reported that the problem of lost luggage was growing. Figures for February 2007 have reached a staggering 366,000 pieces of lost luggage. These losses have increased in spite of technological advance in the travel industry. These technological advances, such as bar coding, provide for more reliable baggage handling, however they remove a more practical human interaction with regards to locating luggage and ensuring that all the luggage for a single passenger remains together.

In one approach to securing a person's belongings, Casper disclosed an under cover security wallet. This three portion portfolio system allows the traveler to organize and hold travel documents and keep them close to his person. The fist portion is connected as a flap member to the second portion, with pockets on both the inside and outside of each portion. The third hinge portion consists of several pockets, included a transparent exterior pocket. There are individual pockets sized for receiving information cards, currency, business cards, credit cards, a calculator and airline tickets.

Another approach according to Grimsley is a travel kit with a foldable multi-panel base allowing for a multi-page insert to be secured to one of two fold lines. The insert contains overlapping panels with pockets that are capable of holding items such as documents, passports, paper and coin currency, maps and credit cards. The travel kit is designed to be carried on the traveler's person.

Yet another approach according to Carp is a combination carrying case and article organizer. The article organizer consists of several sides that contain pockets for storing a multitude of personal documents and items. The sides are attached to a central upright side. The organizer can be folded in on itself and fastened closed with the fasteners on the side flaps. The organizer then fits inside the outer, larger carrying case, such as a wallet would fit into a handbag.

In another approach according to Carp, a combination carry-on luggage bag with tote bag and clutch bag is described. This combination includes four pieces. First, there is a small cocoon purse which fits inside a larger clutch bag. The clutch and cocoon bags may then be placed inside of the larger tote bag which all fits inside of the larger outer carry-on bag.

The travel products described above all offer ways in which to secure a person's documents by providing a wallet-type document holder and outer travel bags that can be carried on the traveler's person. However, these prior inventions fail to address the issue of securing travelers' possessions once they have been checked into the compartment of a plane or train or other separate area that is not within the traveler's immediate control.

As such, what is needed is a more convenient means for locating paired luggage and for rapidly identifying luggage associated with a passenger.

SUMMARY OF THE INVENTION

Disclosed herein is a kit for travelers comprising at least one document holder having at least one pocket for storage of travel related documents; said document holder having a luggage identifier code dispose thereon and readily visible; at least one tamper proof mechanism for securing luggage access to avoid tampering; and one or more luggage tags, wherein the luggage tags, the document holder, the tamper proof mechanism each have a substantially similar indicia disposed thereupon providing a visual means for associating the items together.

In one embodiment, a baggage identification locator apparatus for travelers comprises at least one document holder having at least one pocket for storage of travel related documents; said document holder having a luggage identifier code disposed thereon and readily visible; at least one tamper proof fastener for securing luggage access to avoid tampering; and one or more luggage tags, wherein the luggage tags, the document holder, the tamper proof fastener each have a substantially similar indicia disposed thereupon providing a visual means for associating the items together.

In certain aspects, the apparatus further comprises substantially similar indicia imprinted onto the document holder.

In another embodiment, the apparatus further comprises indicia utilizing easily recognizable characters associated with one or more travel profiles.

In another embodiment, the apparatus further comprises indicia utilizing easily recognizable characters associated with one or more travel profiles wherein the travel profile includes at least one luggage identifier code, at least one associated traveler indicia, and one or more sets of personalized attributes.

A method for identifying luggage comprises the following steps in any order: attaching one or more luggage tags with a predetermined unique indicia to each item of luggage; associating said luggage tags physically to each item of luggage by having a similar image or complementary shape such that a person can easily recognize the associated luggage; associating one or more traveler indicia with one or more sets of personalized attributes; associating said one or more travel attributes personalized with a travel profile; and associating said luggage tags with a travel profile.

In another embodiment, the method further comprises providing one or more tamper proof fasteners to the one or more luggage tags; associating said one or more tamper proof fasteners to one or more closed compartments of said items of luggage; providing one or more wire tie support loops for indication that said items of luggage have been opened; and severing said wire tie loop to indicate that the luggage has been opened.

In another embodiment, the method further comprises providing one or more tamper proof fasteners to the one or more luggage tags; associating said one or more tamper proof fasteners to one or more closed compartments of said items of luggage; providing one or more wire tie support loops for indication that said items of luggage have been opened; and severing said wire tie loop to indicate that the luggage has been opened wherein said luggage tags comprise one or more component pieces that fit together into a single, one piece tag.

In certain aspects, the method further comprises associating said one or more component pieces to said one or more items of luggage to form a common set of traveler indicia; and associating said common set of traveler indicia to one or more traveler profiles.

In another embodiment, the method further comprises providing one or more tamper proof fasteners to the one or more luggage tags; associating said one or more tamper proof fasteners to one or more closed compartments of said items of luggage; providing one or more wire tie support loops for indication that said items of luggage have been opened; and severing said wire tie loop to indicate that the luggage has been opened wherein said one or more component pieces fit together via a snapping mechanical interference fit locking process.

In certain aspects, the common set of traveler indicia may be matching colors. In other aspects, the common set of traveler indicia may be matching images. In certain aspects, the luggage tags may be selected from a group consisting of plastic, acrylic, vinyl, and composite resin material.

In another embodiment, one or more component pieces fit together via a hook and loop construction.

In another embodiment, the method further comprises providing a locator code associating with one or more common set of traveler indicia; providing a matching identification security checkpoint authorization means for a traveler; and matching said authorization means with a traveler profile and a common set traveler indicia.

The construction and method of operation of the invention, however, together with additional objectives and advantages thereof will be best understood from the following description of specific embodiments when read in connection with the accompanying drawings.

DETAILED DESCRIPTION

Figure 1:
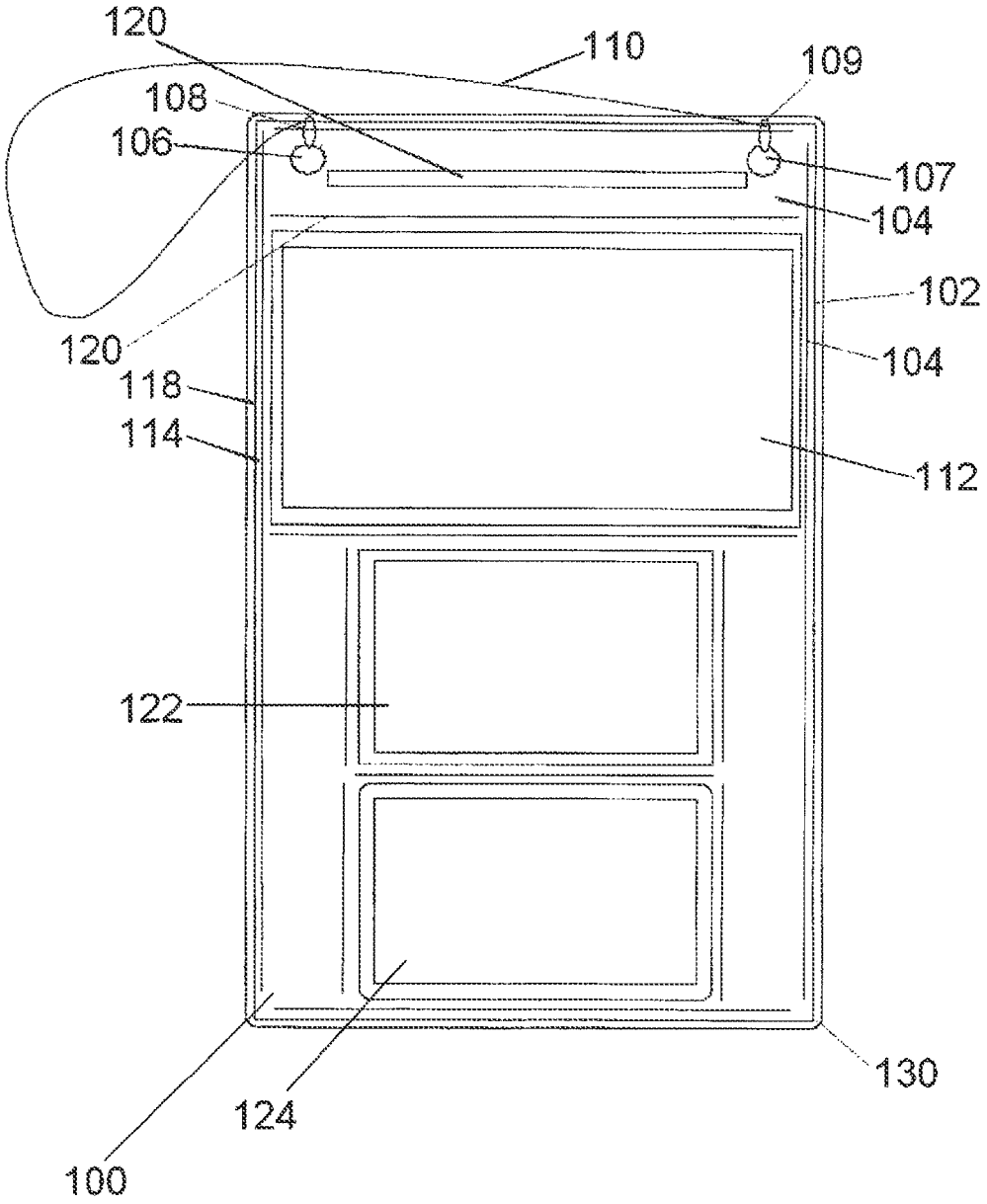
FIG. 1 illustrates one aspect of the current invention, a front view of a holder for travel related documents.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The embodiments of the enclosed invention introduce new systems and methods for providing baggage identification and location. In one embodiment, instructions provide a baggage identification locator system for a traveler by associating one or more indicia with a one or more travel profiles and luggage tags. The instructions include one or more modules communicating directly with a baggage identification locator computer module that provides locator and matching security checkpoint authorization services to an associated indicia and traveler profile.

Exemplary Operating Environments, Components, and Technology FIG. 17 is a block diagram illustrating components of an exemplary operating environment in which various embodiments of the present invention may be implemented. The system 1700 can include one or more user computers, computing devices, or processing devices 1712, 1714, 1716, 1718, which can be used to operate a client, such as a dedicated application, web browser, etc. The user computers 1712, 1714, 1716, 1718 can be general purpose personal computers (including, merely by way of example, personal computers and/or laptop computers running a standard operating system), cell phones or PDAs (running mobile software and being Internet, e-mail, SMS, Blackberry, or other communication protocol enabled), and/or workstation computers running any of a variety of commercially-available UNIX or UNIX-like operating systems (including without limitation, the variety of GNU/Linux operating systems). These user computers 1712, 1714, 1716, 1718 may also have any of a variety of applications, including one or more development systems, database client and/or server applications, and Web browser applications. Alternatively, the user computers 1712, 1714, 1716, 1718 may be any other electronic device, such as a thin-client computer, Internet-enabled gaming system, and/or personal messaging device, capable of communicating via a network (e.g., the network 1710 described below) and/or displaying and navigating Web pages or other types of electronic documents. Although the exemplary system 1700 is shown with four user computers, any number of user computers may be supported.

In most embodiments, the system 1700 includes some type of network 1710. The network may can be any type of network familiar to those skilled in the art that can support data communications using any of a variety of commercially-available protocols, including without limitation TCP/IP, SNA, IPX, AppleTalk, and the like. Merely by way of example, the network 1710 can be a local area network ("LAN"), such as an Ethernet network, a Token-Ring network and/or the like; a wide-area network; a virtual network, including without limitation a virtual private network ("VPN"); the Internet; an intranet; an extranet; a public switched telephone network ("PSTN"); an infra-red network; a wireless network (e.g., a network operating under any of the IEEE 802.11 suite of protocols, GRPS, GSM, UMTS, EDGE, 2G, 2.5G, 3G, 4G, Wimax, WiFi, CDMA 2000, WCDMA, the Bluetooth protocol known in the art, and/or any other wireless protocol); and/or any combination of these and/or other networks.

The system may also include one or more server computers 1702, 1704, 1706 which can be general purpose computers, specialized server computers (including, merely by way of example, PC servers, UNIX servers, mid-range servers, mainframe computers rack-mounted servers, etc.), server farms, server clusters, or any other appropriate arrangement and/or combination. One or more of the servers (e.g., 1706) may be dedicated to running applications, such as a business application, a Web server, application server, etc. Such servers may be used to process requests from user computers 1712, 1714, 1716, 1718. The applications can also include any number of applications for controlling access to resources of the servers 1702, 1704, 1706.

The Web server can be running an operating system including any of those discussed above, as well as any commercially-available server operating systems. The Web server can also run any of a variety of server applications and/or mid-tier applications, including HTTP servers, FTP servers, CGI servers, database servers, Java servers, business applications, and the like. The server(s) also may be one or more computers which can be capable of executing programs or scripts in response to the user computers 1712, 1714, 1716, 1718. As one example, a server may execute one or more Web applications. The Web application may be implemented as one or more scripts or programs written in any programming language, such as Java®, C, C# or C++, and/or any scripting language, such as Perl, Python, or TCL, as well as combinations of any programming/scripting languages. The server(s) may also include database servers, including without limitation those commercially available from Oracle®, Microsoft®, Sybase®, IBM® and the like, which can process requests from database clients running on a user computer 1712, 1714, 1716, 1718.

The system 1700 may also include one or more databases 1720. The database(s) 1720 may reside in a variety of locations. By way of example, a database 1720 may reside on a storage medium local to (and/or resident in) one or more of the computers 1702, 1704, 1706, 1712, 1714, 1716, 1718. Alternatively, it may be remote from any or all of the computers 1702, 1704, 1706, 1712, 1714, 1716, 1718, and/or in communication (e.g., via the network 1710) with one or more of these. In a particular set of embodiments, the database 1720 may reside in a storage-area network ("SAN") familiar to those skilled in the art. Similarly, any necessary files for performing the functions attributed to the computers 1702, 1704, 1706, 1712, 1714, 1716, 1718 may be stored locally on the respective computer and/or remotely, as appropriate. In one set of embodiments, the database 1720 may be a relational database, such as Oracle 10g, that is adapted to store, update, and retrieve data in response to SQL-formatted commands.

FIG. 18 illustrates an exemplary computer system 1800, in which various embodiments of the present invention may be implemented. The system 1800 may be used to implement any of the computer systems described above. The computer system 1800 is shown comprising hardware elements that may be electrically coupled via a bus 1824. The hardware elements may include one or more central processing units (CPUs) 1802, one or more input devices 1804 (e.g., a mouse, a keyboard, etc.), and one or more output devices 1806 (e.g., a display device, a printer, etc.). The computer system 1800 may also include one or more storage devices 1808. By way of example, the storage device(s) 1808 can include devices such as disk drives, optical storage devices, solid-state storage device such as a random access memory ("RAM") and/or a read-only memory ("ROM"), which can be programmable, flash-updateable and/or the like.

The computer system 1800 may additionally include a computer-readable storage media reader 1812, a communications system 1814 (e.g., a modem, a network card (wireless or wired), an infra-red communication device, etc.), and working memory 1818, which may include RAM and ROM devices as described above. In some embodiments, the computer system 1800 may also include a processing acceleration unit 1816, which can include a digital signal processor DSP, a special-purpose processor, and/or the like.

The computer-readable storage media reader 1812 can further be connected to a computer-readable storage medium 1810, together (and, optionally, in combination with storage device(s) 1808) comprehensively representing remote, local, fixed, and/or removable storage devices plus storage media for temporarily and/or more permanently containing, storing, transmitting, and retrieving computer-readable information. The communications system 1814 may permit data to be exchanged with the network and/or any other computer described above with respect to the system 1800.

The computer system 1800 may also comprise software elements, shown as being currently located within a working memory 1818, including an operating system 1820 and/or other code 1822, such as an application program (which may be a client application, Web browser, mid-tier application, RDBMS, etc.). It should be appreciated that alternate embodiments of a computer system 1800 may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, data signals, data transmissions, or any other medium which can be used to store or transmit the desired information and which can be accessed by the computer. Based on the disclosure and teachings provided herein, a person of ordinary skill in the art will appreciate.

FIG. 1 illustrates one aspect of the current invention, a front view of a holder apparatus for travel related documents 100. The holder 100 is formed about a central sheet 102, typically rectangular in shape and may be fabricated from a combination of leather and clear plastic or vinyl or acrylic, or any other similar combination of materials to provide the support needed and, where appropriate, a clear material for seeing documents contained therein. The holder apparatus 100 is comprised of nonmetallic parts allowing for easy passage through metal detectors. The central sheet 102 should be sufficiently rigid to allow the holder 100 to maintain its relative shape and to permit easy insertion and retrieval of travel credentials. A top portion of the central sheet 102 may have a reinforcement region 104 with cutouts 106 and 107 with metal rings 108 and 109 for attaching a carrying strap or lanyard 110 thereto. The lanyard 110 allows the traveler to wear the holder about their neck or shoulder. Optionally, a reinforcement region 104 may be used to attach a reel-style clip or belt clip such that the clip permits the holder to be attached to the traveler's clothing. After having reviewed the disclosure, one of ordinary skill in the art will understand that the holder can be "worn" by the traveler in a variety of ways. For example, the clip mechanism can be directly connected to the traveler's clothing, duffle bag, purse handle, etc.

A first pocket 112 may be similar in shape to the central sheet 102 and sized to receive a document such as a passport. The first pocket 112 may be attached to the central sheet 102 by any number of standard methods such as thermal bonding, adhesive, rivets, press molding, or sewn. In the illustrated embodiment, the first pocket 112 is press molded to the central sheet 102 along two elongated sides 114 and one shorter side 116 to create a border region 118. A first pocket opening 120 for the insertion or retrieval of travel credentials is disposed parallel to side 116. The first pocket 112 may be fabricated from clear plastic, vinyl, acrylic, or any other similar clear material that allows the important document information to be visible through the first pocket 112.

As further seen in FIG. 1, additional pockets of varying sizes may be layered onto the first pocket 112 or disposed alongside the first pocket 112. For example, a second pocket 122 may be formed alongside the first pocket 112 and sized for receiving and securing a document such as a medical emergency card. Further, a third pocket 124 may then be formed and sized for receiving and securing a document such as a driver's license. A back side of the back cover flap 130 secures the holder assembly. The applicants appreciates that each pocket opening may be closed by a variety of fastening means such as a zipper, button, Velcro tab, snaps, etc.

Figure 2:
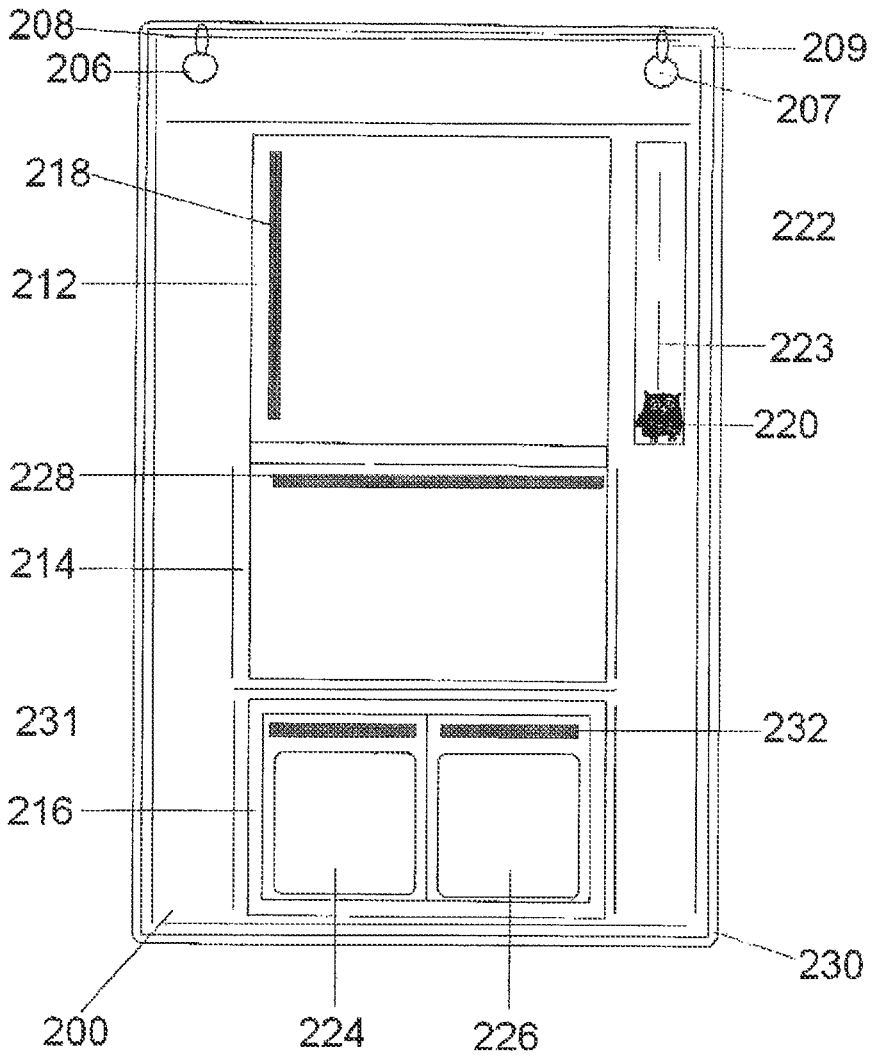
FIG. 2 illustrates another aspect of the current invention, a rear view of a holder for travel related documents.

FIG. 2 illustrates another aspect of the current invention, a rear view of a holder apparatus for travel related documents 200. A top portion of the holder 200 may have cutouts 206 and 207 for attaching a carrying strap or lanyard thereto. Another portion of the holder 200 has a reinforcement region forming a utility pocket 212 said pocket being sealable and accessible by use of a zipper 218 or other enclosure means such as VELCRO, snaps or buttons. The utility pocket may be formed from plastic, vinyl or other clear or opaque or some combination thereof. An additional pocket 214 may also be formed in the same manner as the utility pocket 212 for storage of utility items such as jewelry which needs to be removed when traveling through an airport metal detector. This provides the traveler with an easy place to store valuables without having to place them in plastic tubs for scanning at airports. The pocket 214 being sealable and accessible by use of a zipper 228 or other enclosure means such as a hook and loop fastener such as VELCRO, snaps or buttons. Two additional pockets 224 and 226 are provided for storage of footwear to be worn while traveling through security area. This allows convenient access to protective footwear while shoes are being scanned by security personnel. The two additional pockets 224 and 226 are formed in a manner similar to the utility pocket 212 and are sealable and accessible by use of zippers 231 and 232 respectively or other enclosure means such as VELCRO, snaps or buttons.

The side of the holder apparatus 200 has graphical indicia 220 for identification of the holder 200 with additional baggage. The indicia may be any means imprinted or impressed into the holder 200 to provide for a visually recognizable image. The indicia 220 may be any image, graphic or logo that may be visually associated with other items and baggage carried by the traveler. The inventors anticipate using easily recognizable characters such as animals and plants; however other images, including personalized images may also effectuate the invention. The indicia may also be effectuated through simple matching colors or color patterns such as a rainbow. The indicia could also be of well know animal characters or easily recognizable landmarks. It would be in the spirit of this invention to utilize it by creating and employing icons and images that would appeal to travelers as well. More stylized indicia could be employed such as images or names of fictional characters or real people. This might allow others to identify a face or character with the holder 200 or associated baggage. Also, one having skill in the art could effectuate the same result by placing the indicia 416 on the backside of the back flap 430.

FIG. 2 also illustrates a luggage identifier code (LIC) 222. The LIC 222 includes a unique identification number comprising of numeric, alphabetic or alphanumeric characters along with a telephone number. Along with the LIC is a telephone number 223. The LIC 222 and telephone number are disposed on the holder 200 such that the LIC 222 and telephone number 223 are visibly separated by being disposed in a colored region 225 said colored being brighter than the surrounding material such that the eye is drawn to the LIC 222 and telephone number 223. In certain aspects, the system utilizes common security colors such as red or orange. In the event the holder apparatus 200 is lost, one can easily call the telephone number 223 displayed and use the LIC 222 to contact the rightful owner. Alternatively, a luggage locating service, system and computer implemented method may be employed to effectuate the same result utilizing exemplary operating environments, components, and technology as outlined above and shown in FIGS. 17 and 18. In yet another embodiment, a luggage locator service would be accessible through a toll-free telephone number and would associate the LIC 222 to the rightful owner and may arrange for luggage transportation if required. FIG. 230 is the back cover.

Figure 3:
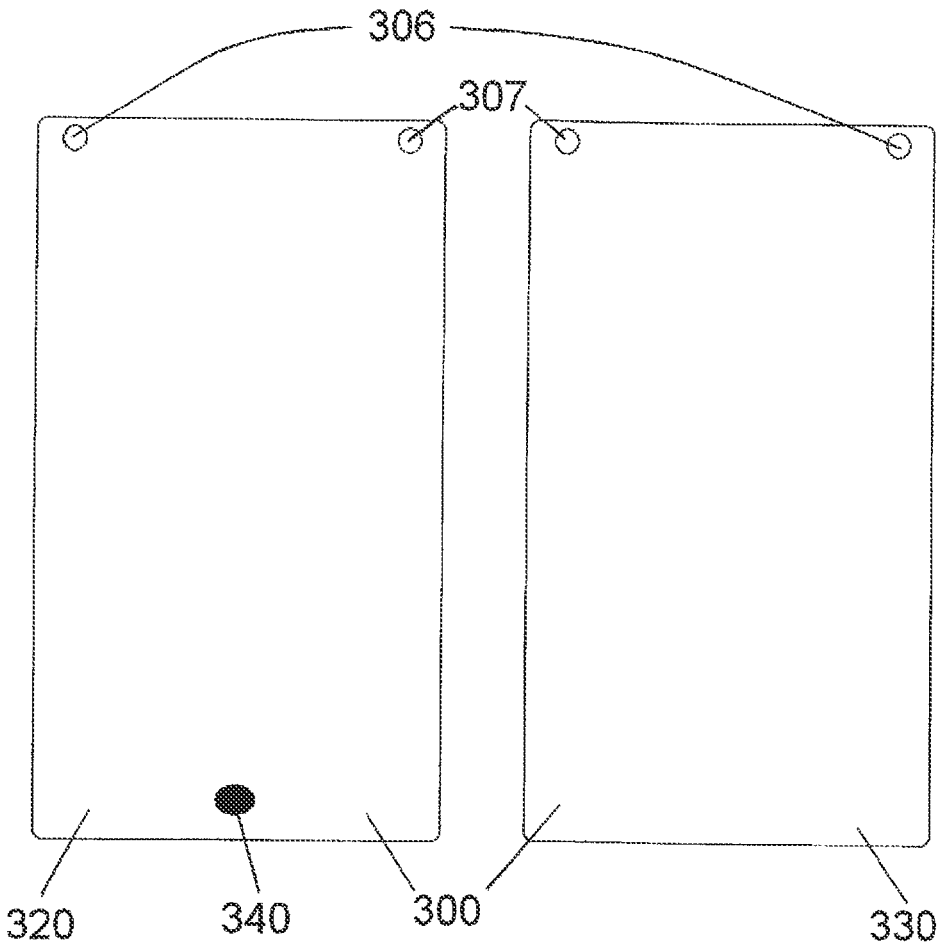
FIG. 3 illustrates a front and back view of the front flap which covers a holder for travel related documents.
Figure 4:
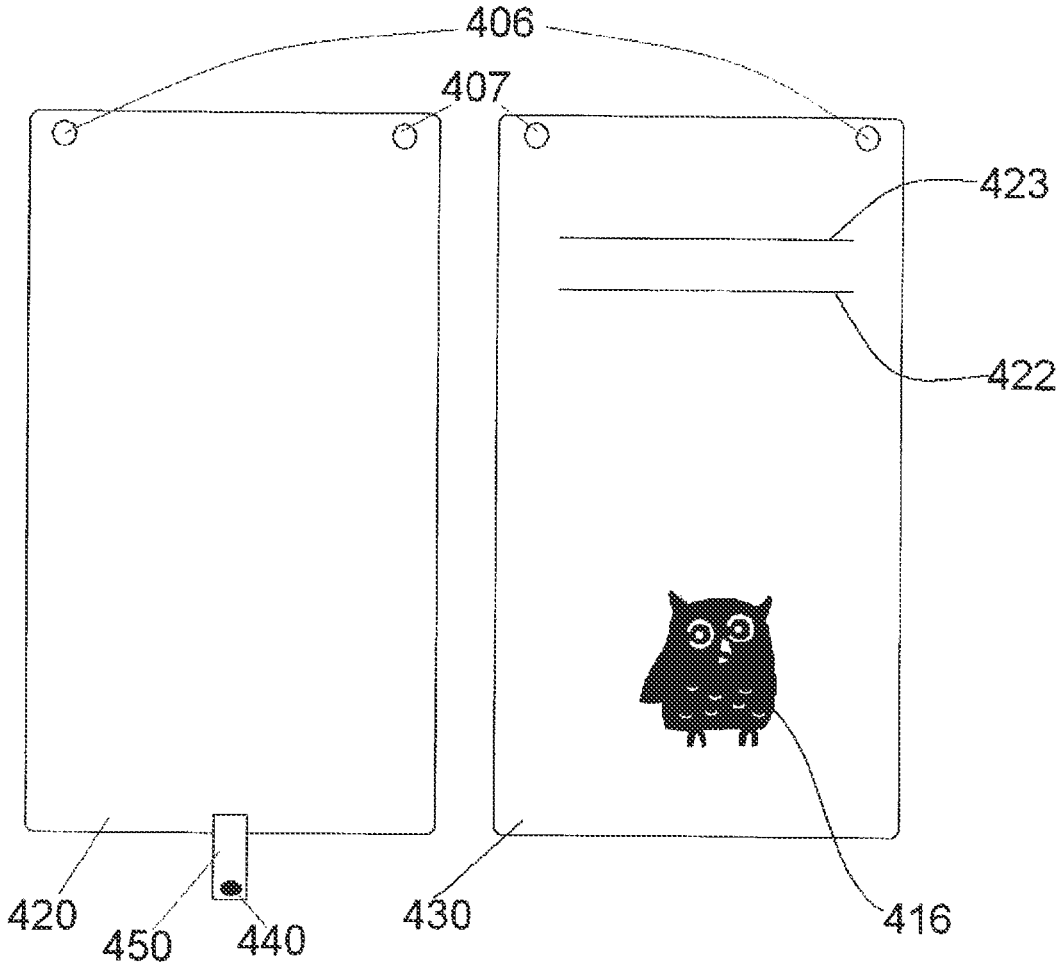
FIG. 4 illustrates a front and back view of the back flap which covers a holder for travel related documents.

The embodiments of FIGS. 1 and 2 may be constructed to form a front and one or more rear flaps of a single holder assembly FIG. 3 and FIG. 4 respectively. The holder assembly of FIGS. 1 and 2 are enclosed in a set of flaps FIGS. 3 and 4 such that the set of flaps covers the holder assembly and provides for an attractive appearance. The disclosed flaps are constructed of leather, simulated leather, or other suitable material to present a pleasing appearance when worn. The flaps are attached with a hook 340 and a loop 440 fastener such as VELCRO; however, other fastening means may be used to effectuate the same result. One having skill in the art will appreciate that back flap 400 combined with the front flap 300 may be made from a variety of attractive and decorative materials.

FIG. 3 illustrates the front side 320 and the back side 330 of the front flap 300 which covers the holder assembly of FIGS. 1 and 2. A top portion of the flap may have cutouts 306 and 307 for attaching a carrying strap or lanyard thereto. A bottom portion of the front side 320 of the front flap 300 has a receiving end of the closing mechanism 340 (Describe that button?)

FIG. 4 illustrates the inside part 430 and the outside part 420 of the back flap 400. A top portion of the flap may have cutouts 406 and 407 for attaching a carrying strap or lanyard thereto. A bottom portion of the outside part 420 of the flap 400 may have a part of the closing mechanism which could be made of a button 440 which is attached to a stripe 450, which would wrap around the holder assembly to allow the button 440 to fit into the opening 340 to secure the holder assembly. The inside portion 430 of the back flap has identifying features to provide for the easier identification. In addition to the indicia 416 the luggage identifier code (LIC) 423 and the telephone number (422) could be placed on the inside of the back flap to allow for an easy and quick identification in case an item gets lost.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 5:
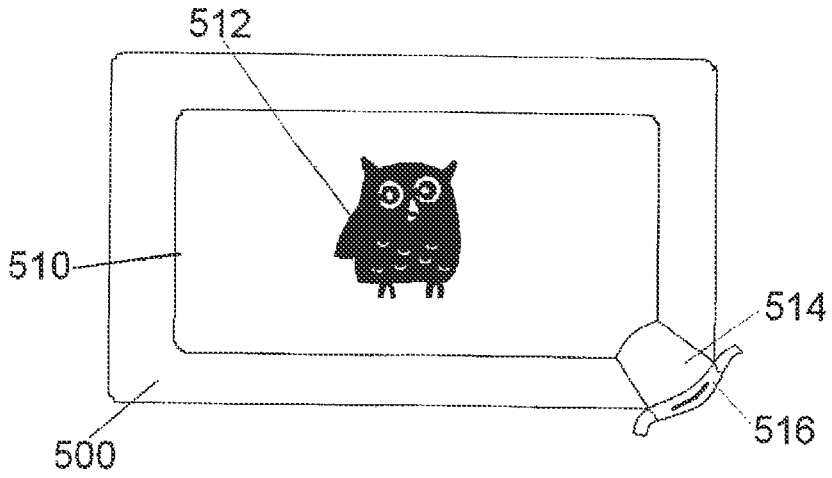
FIG. 5 illustrates another embodiment of a second aspect of the current invention, a tamper proof mechanism.

FIG. 5 illustrates another embodiment of a second aspect of the current invention, a tamper proof mechanism 500. The tamper proof tag mechanism 500 is designed to indicate if someone has breached the security of the luggage. They are attached to closed compartments during travel. By providing an indication that someone has opened the luggage they act to avoid pilfering of property from the luggage. In FIG. 5 a holder 510 having indicia 512 matching other indicia described above, is composed of plastic, vinyl or other nonmetallic material suitable for supporting the indicia 512 and for supporting a loop 514. Through the loop is inserted a wire tie 516, said wire tie 516 being used to securely fastened closed openings on luggage. In operation for the luggage to be opened the wire tie must be severed and the tamper proof mechanism 500 removed thus indicating that the luggage has been opened. In the event authorized security opens the luggage, a written notice is usually employed, so that if a written notice is not received, one may have an indication the luggage has been tampered with.

One having skill in the art will appreciate that other security devices may be used in place of the wire tie to effectuate the same result. This list includes but is not limited to medical patient bracelets and colored concert security bracelets which act to prevent removal without destroying the bracelet itself. Additionally the indicia 512 acts to indicate visually the owner of the luggage by providing a visual indication of the associated luggage and any associated holder FIG. 1 or FIG. 2 described above.

Figure 6:
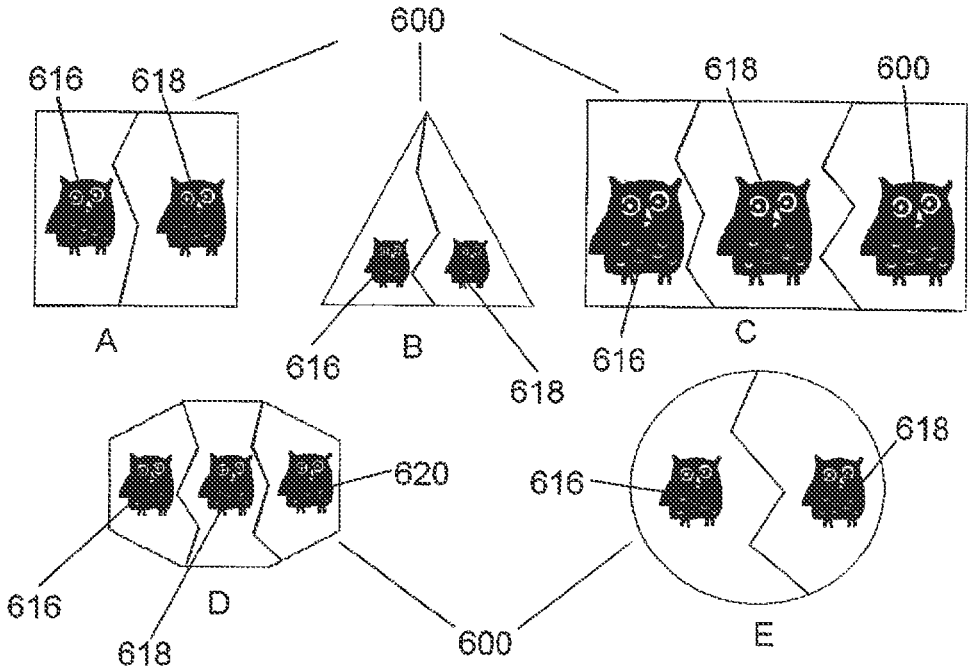
FIG. 6 illustrates interlocking multipart luggage tags with indicia.

FIG. 6 illustrates interlocking multipart luggage tags 600 with indicia 616, 618, and 620. The tags 600 are designed to share a common indicia such that one can easily distinguish the luggage marked with these tags as being associated as part of a same set. Various shapes with interlocking pieces such as squares (A), triangles (B), circles (C), hexagons (D) and star (E) shapes may be employed in this embodiment. The indicia 616, 618, and 620 would be selected to match the indicia described above such that it provides an easy way to recognize association between every item tagged with the luggage tags 600. The indicia 616, 618, and 620 may be any means imprinted or impressed into the tags 400 to provide for a visually recognizable image. The indicia 616, 618, and 620 may be any image, graphic or logo that may be visually associated with other items and baggage carried by the traveler. The inventors anticipate using easily recognizable characters such as animals and plants; however other images, including personalized images may also effectuate the invention. The indicia 616, 618, 620 may also be effectuated through simple matching colors or color patterns such as a rainbow. The indicia 616, 618, and 620 could also be of well know animal characters or easily recognizable landmarks. It would be in the spirit of this invention to utilize it by creating and employing icons and images that would appeal to travelers as well. More stylized indicia 616, 618, and 620 could be employed such as images or names of fictional characters or real people. This might allow others to identify a face or character with the tags on associated baggage.

Luggage tags 400 may be constructed form plastic, acrylic, vinyl or any other suitable material capable of having the indicia 616, 618, and 620 disposed thereon.

Figure 7:
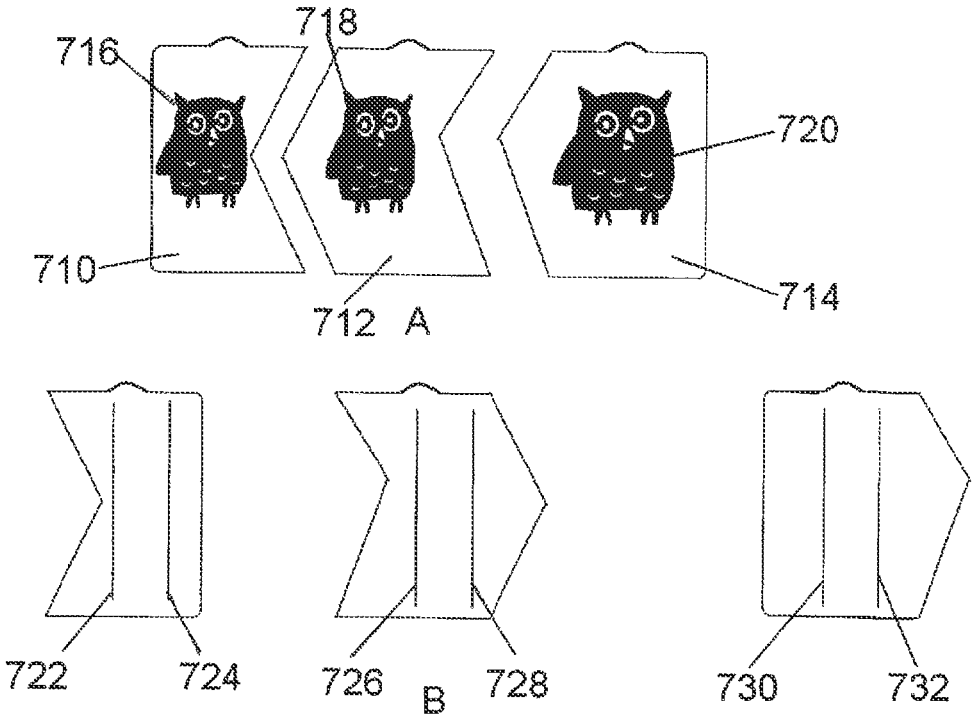
FIG. 7 illustrates another aspect of this embodiment showing luggage tags fitted together with the writing space on the back of them.

FIG. 7 illustrates another aspect of this embodiment showing luggage tags fitted together. The tags described in previous embodiments may also fit together as puzzle pieces such that one can easily see the number of luggage items associated together by putting the puzzle together. For example, a puzzle that appears complete with only two pieces would indicate to a user that there are only two luggage items associated. In FIG. 7, three tags 710, 712 and 714 are fitted together as a puzzle with each tag having indicia 716, 718 and 720 respectively. Tags may snap together using any number of common locking schemes or a hook and loop construction. Referring back to FIG. 5, the unique shape of the tags 510, 512 and 514 provide a visual indication of the number of luggage items while the indicia 516, 518 and 520 provide a visual indication of the associated luggage.

The reverse side of a tag is a name tag having a space to enter traveler's name 522, 526, 528 and contact telephone number 524, 528, and 526.

FIG. 6 illustrates the front side of the both front and back covers with cutouts 606 and 607.

FIG. 7 illustrates the back side of the both front and back covers with cutouts 706 and 707. FIG. 730 is the back side of the back cover. FIG. 720 illustrates graphic indicia for easy identification. FIGS. 722 and 723 illustrate space where further identification can be written subject to the fields and record requirements of the program code instructions of the exemplary embodiments.

Now referring further to FIG. 7, the luggage tag (A) may be constructed form plastic, acrylic, vinyl or any other suitable material capable of having the indicia disposed thereon. The reverse side of the luggage tag is a name tag (B) having a space to enter a traveler's name 522 and contact telephone number 524.

One of the many unique features of the current disclosure is that by placing similar indicia on the differing aspects of the current disclosure, a traveler has increased the visibility of their luggage and has provided for a visual linking such that even untrained users may identify and associate luggage form a single traveler together. This reduces the risk of lost luggage and provides an easy means for a traveler to locate their luggage on a luggage carousel or similar device for presenting luggage to a traveler. Security requirements often entail the traveler displaying a boarding pass and photo identification at the curbside check-in, ticket counter, security checkpoints, boarding gate or other areas. With the embodiment of FIGS. 1 and 2, a traveler simply has to "wear" the disclosed embodiment to readily display the requested documentation including data printed from an exemplary operating system and program code providing instructions to perform the method steps described herein. The present disclosure eliminates the hassle of searching through bags, purses, etc. at various travel destinations. Additionally the graphical indicia and locator code provide an easy way at a security check point to locate items that belong to the traveler because the indicia on the holder will match the indicia on the luggage tags and name tags.

According to one embodiment, each user system and all of its components are operator configurable using applications, such as a browser, including computer code run using a central processing unit such as an Intel Pentium® processor or the like. Similarly, System (and additional instances of an MTS, where more than one is present) and all of their components might be operator configurable using application(s) including computer code run using a central processing unit such as an Intel Pentium® processor or the like, or multiple processor units. A computer program product aspect includes a machine-readable storage medium (media) having instructions stored thereon/in which can be used to program a computer to perform any of the processes of the embodiments described herein. Computer code for operating and configuring System 16 to intercommunicate and to process web pages, applications and other data and media content as described herein is preferably downloaded and stored on a hard disk, but the entire program code, or portions thereof, may also be stored in any other volatile or non-volatile memory medium or device as is well known, such as a ROM or RAM, or provided on any media capable of storing program code, such as any type of rotating media including floppy disks, optical discs, digital versatile disk (DVD), compact disk (CD), microdrive, and magneto-optical disks, and magnetic or optical cards, nanosystems (including molecular memory ICs), or any type of media or device suitable for storing instructions and/or data. Additionally, the entire program code, or portions thereof, may be transmitted and downloaded from a software source over a transmission medium, e.g., over the Internet, or from another server, as is well known, or transmitted over any other conventional network connection as is well known (e.g., extranet, VPN, LAN, etc.) using any communication medium and protocols (e.g., TCP/IP, HTTP, HTTPS, Ethernet, etc.) as are well known. It will also be appreciated that computer code for implementing aspects of the present invention can be implemented in any programming language that can be executed on a client system and/or server or server system such as, for example, in C, C++, HTML, any other markup language, Java™, JavaScript, ActiveX, any other scripting language such as VBScript, and many other programming languages as are well known. (Java™ is a trademark of Sun Microsystems, Inc.).

As discussed above, embodiments are suitable for use with the Internet, which refers to a specific global internetwork of networks. However, it should be understood that other networks can be used instead of the Internet, such as an intranet, an extranet, a virtual private network (VPN), a non-TCP/IP based network, any LAN or WAN or the like.

Figure 8:
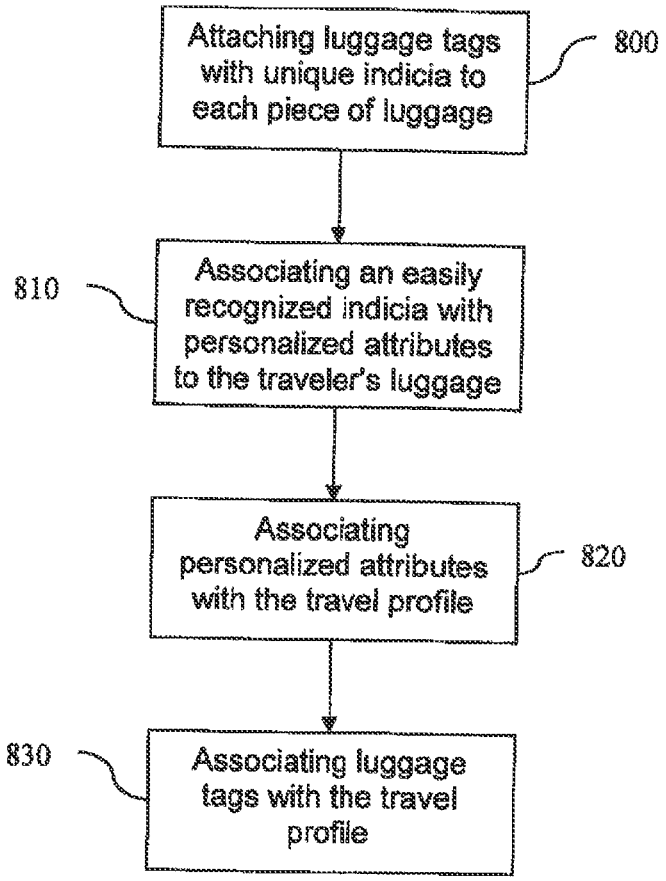
FIG. 8 illustrates a method for associating a traveler's luggage with the traveler's profile using personalized indicia presented on the luggage tags.

FIG. 8 illustrates a method for associating a traveler's luggage with the traveler's profile using personalized indicia presented on the luggage tags 800. The traveler can choose easily recognizable personalized indicia 810, which can be applied to the luggage tags. The indicia are associated with the traveler's travel profile 820, 830. The luggage tags containing the personalized indicia associated with a travel profile can then be physically attached to the luggage 800.

Figure 9:
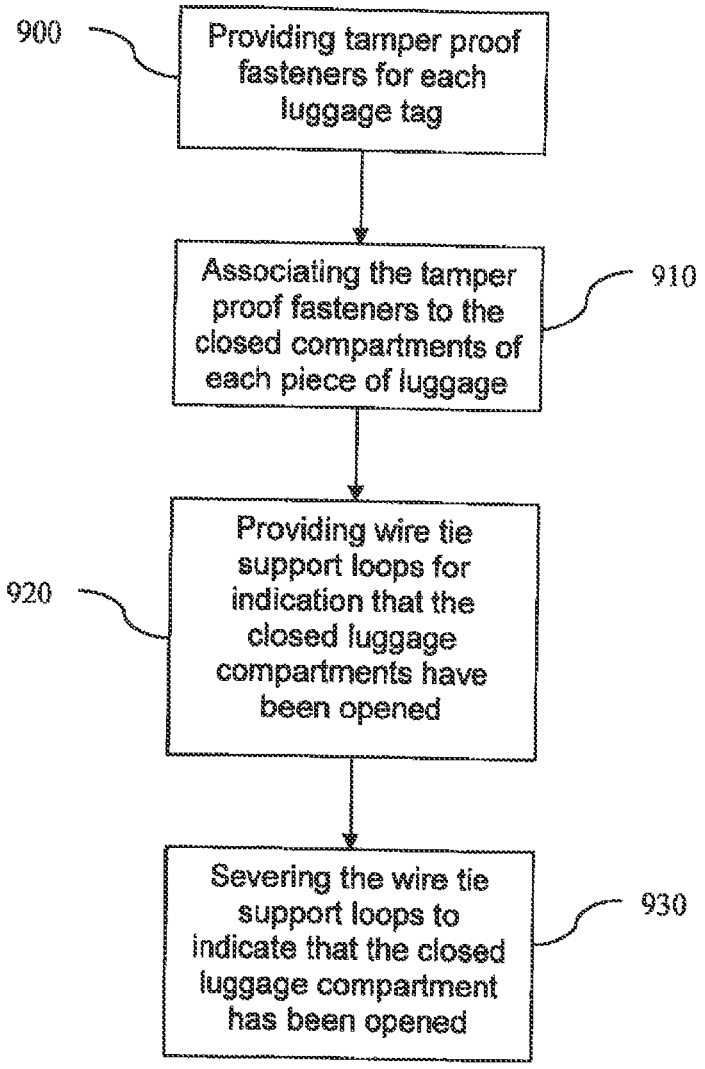
FIG. 9 illustrates a method for indicating whether a traveler's luggage has been opened.

FIG. 9 illustrates a method for indicating whether a traveler's luggage has been opened using a fastener that must be broken in order to access the inside compartment of the traveler's luggage 900, 910, 920, 930. First, a tamper proof fastener is provided for each luggage tag 800. Next, the tamper proof fasteners are associated with the closed compartments of the traveler's luggage 910. The tamper proof fasteners can be made of wire loops and one or more can be attached to the closed compartments of the traveler's luggage 920. Finally, when the wire loops are severed, the traveler is notified that the luggage compartment has been opened 930.

Figure 10:
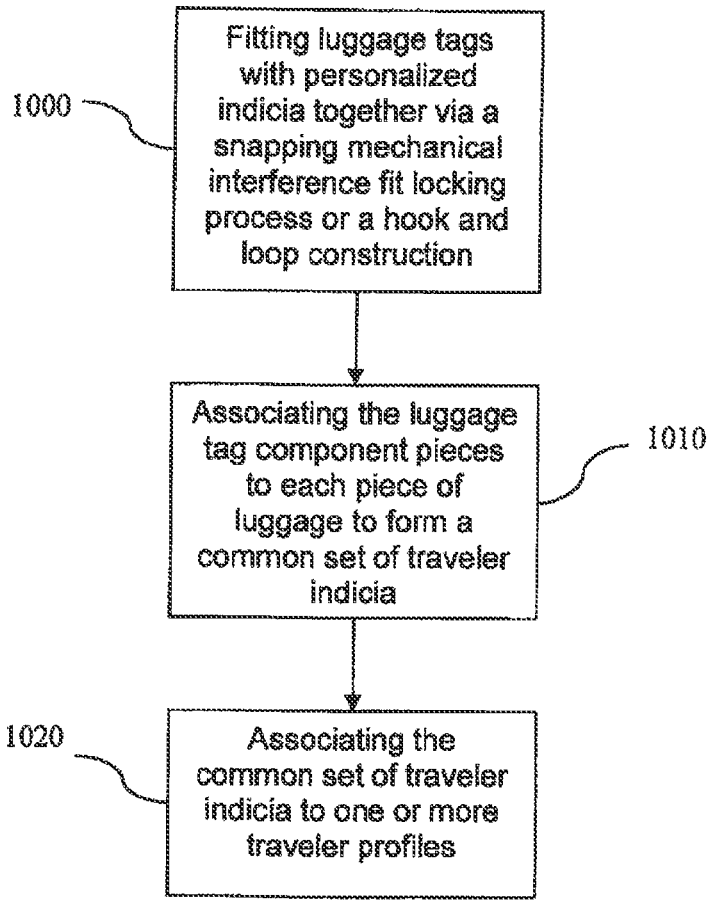
FIG. 10 illustrates a method for associating personalized indicia luggage tag components.

FIG. 10 displays a method for associating personalized indicia luggage tag components. This method includes fitting the luggage tags with personalized indicia together utilizing a snapping mechanical interference fit locking process, a hook and loop construction or other fitting method 1000. The luggage tag component pieces can be associated to each piece of a traveler's luggage to form a common set of traveler personalized indicia 1010 which is then associated with one or more travel profiles 1020.

Figure 11:
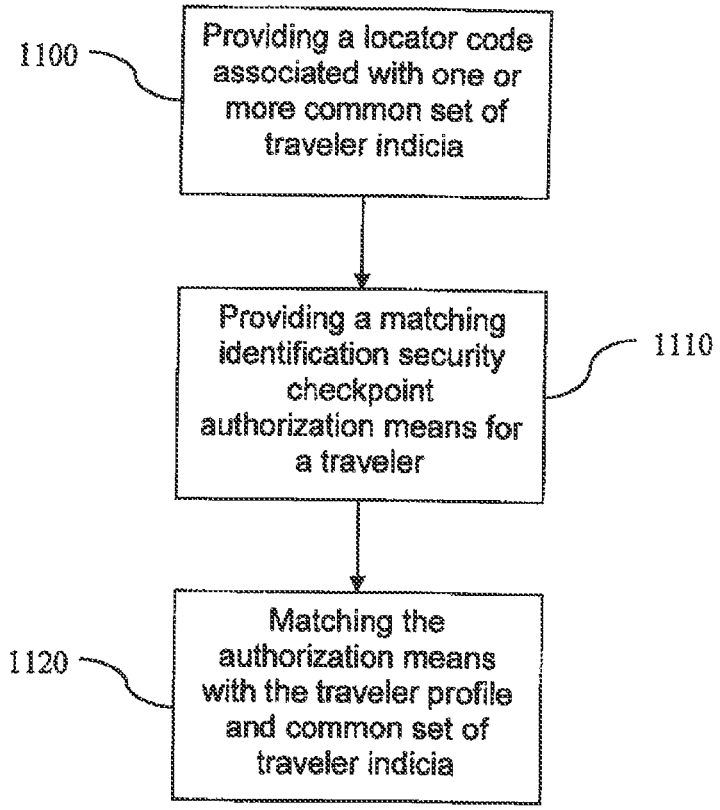
FIG. 11 illustrates a method for associating locator codes with corresponding passengers.
Figure 12:
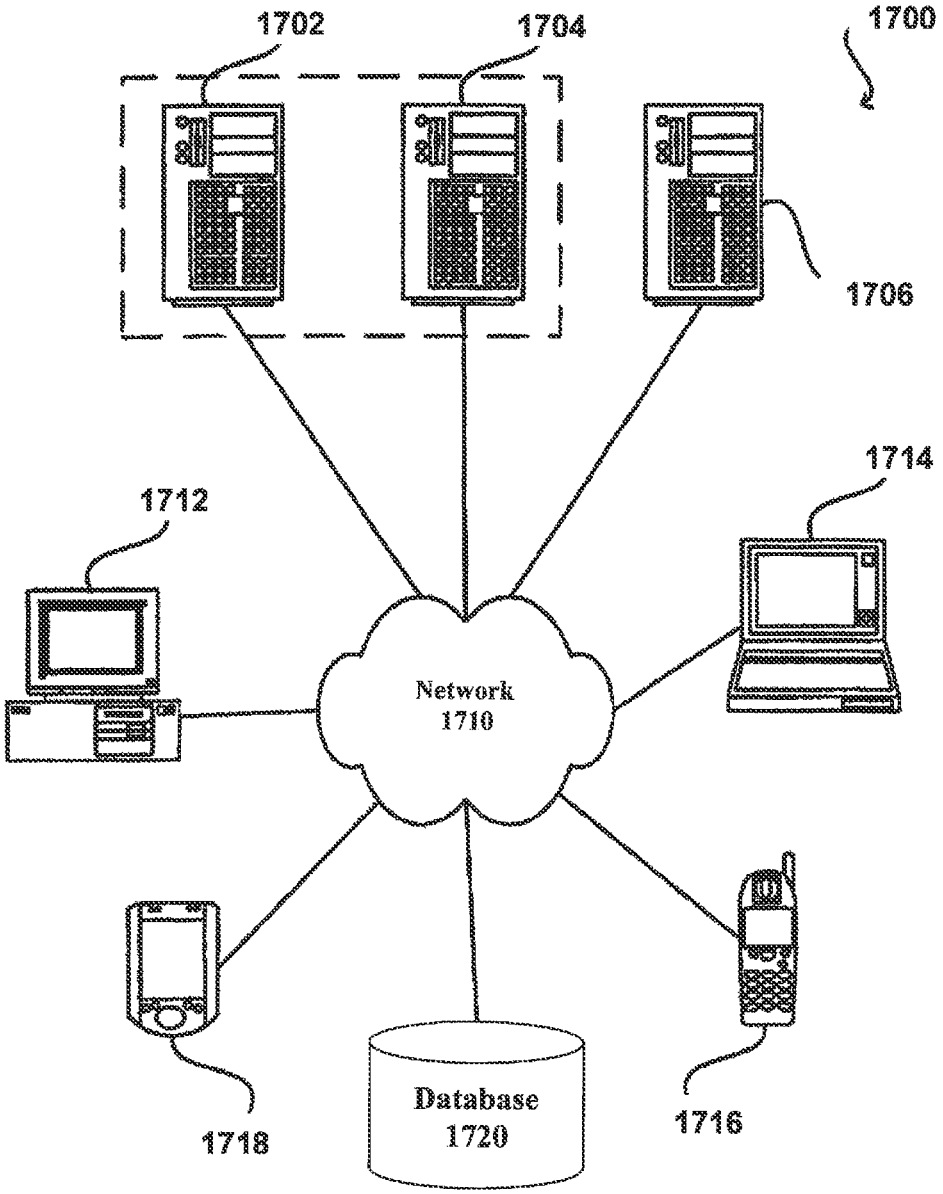
FIG. 12 shows a block diagram illustrating components of an exemplary operating environment.
Figure 13:
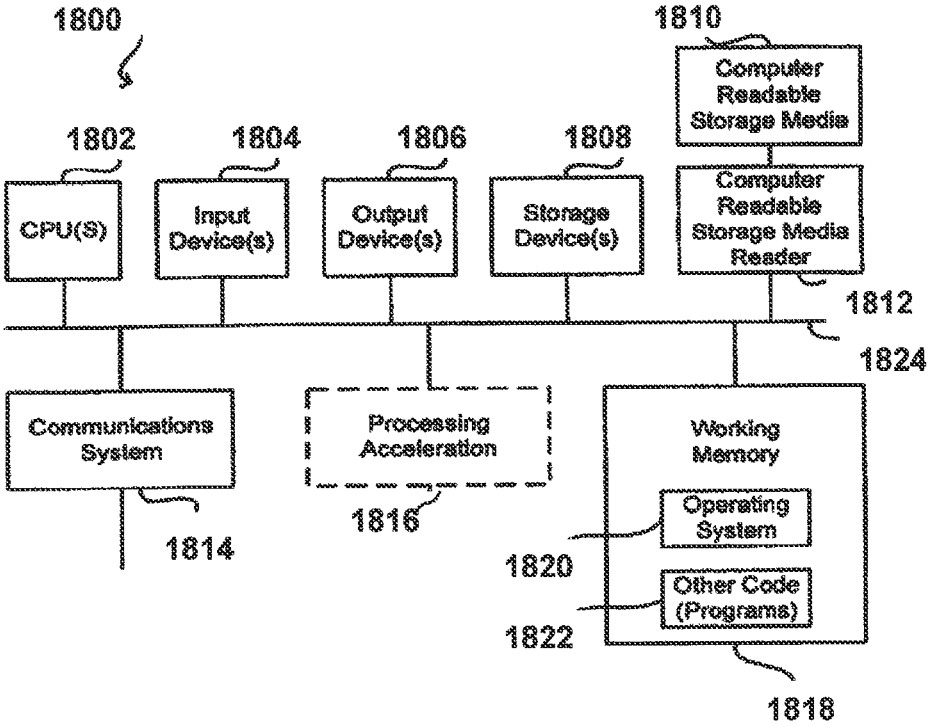
FIG. 13 illustrates an exemplary computer system, in which various embodiments of the present invention may be implemented.

FIG. 11 displays a method for associating locator codes to corresponding passengers in order to track a traveler's luggage. This method includes associating a locator code with one or more common sets of a traveler's personalized indicia 1100. Next, a matching identification security checkpoint could be established as a means of authorization for the traveler 1110. Finally, the common set of personalized travel indicia and travel profile can be matched with the authorization means 1120.

In summary, the baggage identification locator systems and methods described herein can be seen as comprised of five parts. First, there is the travel kit apparatus which resembles a travel wallet. Second are the luggage tags portraying the traveler's personalized indicia. The luggage tags also contain the luggage identifier code (LIC), which allows the third component of the baggage identification locator systems and methods, the software, to identify and track the corresponding traveler's luggage. Tamper proof mechanisms notify the traveler that their luggage has been opened. Finally, the hardware component or computer system of the baggage identification locator systems and methods allows the software to run and also provides the infrastructure for ensuring the traveler's luggage security and location.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method for locating, tracking, and securing a luggage, the luggage comprising a plurality of items, the plurality of items in a plurality of compartments, the method comprising:

providing a plurality of luggage tags, one or more luggage tags of the plurality of luggage tags configured, by a computing device, with a luggage identifier code;

associating, by said computing device, said luggage identifier code with a travel profile;

providing a plurality of tamper proof fasteners to said plurality of luggage tags;

associating said plurality of tamper proof fasteners to said plurality of compartments, wherein said plurality of tamper proof fasteners comprises a plurality of wire tie support loops wherein severing of a wire tie support loop of said plurality of wire tie support loops indicate that a respective compartment has been opened;

wherein each luggage tag of the plurality of luggage tags is of a complementary shape such that the plurality of luggage tags interlocks to form a composite tag;

wherein said plurality of luggage tags configured to interlock through a snapping mechanical interference fit locking process.

2. The method of claim 1, wherein the method further comprises a step of:

providing a locator, the locator coupled to said computing device, the locator configured to read said luggage identifier code.

3. The method of claim 2, wherein said locator is provided at a security checkpoint.

4. The method according to claim 1, wherein the each luggage tag of the plurality of luggage tags has a similar image.

5. The method according to claim 1, wherein at least two luggage tags of the plurality of luggage tags have interlocking shapes.

6. The method according to claim 1, wherein the plurality of luggage tags corresponds to pieces of a jigsaw puzzle, wherein interlocking the plurality of luggage tags to form the composite tag corresponds to interlocking the pieces of the jigsaw puzzle.

7. A method for locating, tracking, and securing a luggage, the luggage comprising a plurality of items, the plurality of items in a plurality of compartments, the method comprising:

providing a plurality of luggage tags, one or more luggage tags of the plurality of luggage tags configured, by a computing device, with a luggage identifier code;

associating, by said computing device, said luggage identifier code with a travel profile;

providing a plurality of tamper proof fasteners to said plurality of luggage tags;

associating said plurality of tamper proof fasteners to said plurality of closed compartments, wherein said plurality of tamper proof fasteners comprises a plurality of wire tie support loops wherein severing of a wire tie support loop of said plurality of wire tie support loops indicate that a respective compartment has been opened;

wherein each luggage tag of the plurality of luggage tags is of a complementary shape such that the plurality of luggage tags interlocks to form a composite tag;

wherein said plurality of luggage tags configured to interlock through a hook and loop construction.

8. The method of claim 7, wherein the method further comprises a step of:

providing a locator, the locator coupled to said computing device, the locator configured to read said luggage identifier code.

9. The method of claim 8, wherein said locator is provided at a security checkpoint.

* * * * *